US007821331B2

(12) United States Patent
Krishna

(10) Patent No.: US 7,821,331 B2
(45) Date of Patent: Oct. 26, 2010

(54) REDUCTION OF TEMPERATURE DEPENDENCE OF A REFERENCE VOLTAGE

(75) Inventor: Radha Krishna, Jayanagar (IN)

(73) Assignee: Cypress Semiconductor Corporation, San Jose, CA (US)

( * ) Notice: Subject to any disclaimer, the term of this patent is extended or adjusted under 35 U.S.C. 154(b) by 14 days.

(21) Appl. No.: 11/636,116

(22) Filed: Dec. 6, 2006

(65) Prior Publication Data

US 2008/0111617 A1 May 15, 2008

(30) Foreign Application Priority Data

Oct. 23, 2006 (IN) ..... 1948/CHE/2006

(51) Int. Cl.
*G05F 3/24* (2006.01)
*G05F 3/26* (2006.01)

(52) U.S. Cl. ..... 327/541; 327/513; 327/543; 323/313; 323/315; 323/907

(58) Field of Classification Search ..... 327/539
See application file for complete search history.

(56) References Cited

U.S. PATENT DOCUMENTS 4,654,578 A * 3/1987 Salerno et al. ..... 323/313
5,426,616 A * 6/1995 Kajigaya et al. ..... 365/226
5,644,216 A * 7/1997 Lopez et al. ..... 323/315
6,133,718 A * 10/2000 Calafato et al. ..... 323/312
6,724,243 B2 * 4/2004 La Rosa ..... 327/543
6,762,629 B2 * 7/2004 Tam et al. ..... 327/114
6,798,278 B2 * 9/2004 Ueda ..... 327/541
6,876,251 B2 * 4/2005 Watanabe ..... 327/541
7,382,029 B2 * 6/2008 Pekarik et al. ..... 257/392

OTHER PUBLICATIONS

Razavi, Behzad. 2002. "Design of Analog CMOS Integrated Circuits". McGraw Hill. pp. 385.
Allen, Phillip and Holberg, Douglas. "CMOS Analog Circuit Design", second edition, Oxford University Press, 2002, pp. 153-165.

* cited by examiner

*Primary Examiner*—Lincoln Donovan
*Assistant Examiner*—Terry L Englund

(57) ABSTRACT

An apparatus and a method to reduce temperature dependence of a reference voltage have been presented. In one embodiment, the method includes generating a reference voltage associated with a difference between a first threshold voltage of a first transistor and a second threshold voltage of a second transistor. The method may further include biasing the first transistor and the second transistor at a predetermined ratio of currents of the first and the second transistors to reduce temperature dependence of the reference voltage.

15 Claims, 5 Drawing Sheets

REDUCTION OF TEMPERATURE DEPENDENCE OF A REFERENCE VOLTAGE

REFERENCE TO RELATED APPLICATION

This application claims the benefit of related parent Indian Patent Application No. 1948/CHE/2006, filed on Nov. 23, 2006.

TECHNICAL FIELD

The present invention relates generally to integrated circuits (ICs), and more particularly, to reducing temperature dependence of a reference voltage.

BACKGROUND

Currently, many integrated circuits (ICs) include circuitry to generate reference voltages used by other components in the ICs. For example, a comparator in an IC may compare an input voltage to a reference voltage generated by a reference voltage circuitry in the same IC and further operations may be triggered in response to the result of the comparison. To improve the accuracy of the IC, a relatively stable reference voltage is desired. However, reference voltages generated in some conventional circuitry may vary significantly with temperature. For example, a reference voltage that corresponds to a difference between the threshold voltages of two transistors (a.k.a. delta threshold voltage reference) in an IC may vary with temperature because the overdrive (VGS-VTH) of both the transistors may not vary in an identical manner. In weak-inversion region of operation, this translates to the mobility variation with temperature of both the transistors may not be equal.

One conventional circuit to generate a reference voltage with reduced temperature dependence is shown in FIG. 1. The circuit 100 generates a first order bandgap reference voltage. Thus, the circuit 100 is also referred to as a first order bandgap reference voltage generating circuit. The circuit 100 includes two bipolar junction transistors (BJTs) Q1 and Q2, three resistors R1, R2, and R3, and an operational amplifier 130. The collectors of Q1 and Q2 are coupled together to the ground. The emitter of Q1 is coupled to one end of R1 at node 131, while the other end of R1 is coupled to node 190. The emitter of Q2 is coupled to one end of R3, while the other end of R3 is coupled to node 132. R2 is coupled between node 132 and node 190. A positive input of operational amplifier 130 is coupled to node 131 and a negative input of operational amplifier 130 is coupled to node 132. The voltages at nodes 131 and 132 are hereinafter referred to as V+ and V−, respectively. The output of operational amplifier 130 is coupled to node 190. A reference voltage (Vref) is output at node 190. The operation of the circuit 100 is described below.

In general, the operational amplifier 130 maintains V+ and V− to be substantially the same. Since the base and the collector of Q1 are coupled to the ground, V+ substantially equals to the emitter-base voltage of Q1, i.e., $V+=V_{BE1}$. As for V−, the value of V− is the sum of the voltage across R3 and the emitter-base voltage of Q2, i.e., $V-=I*R3+V_{BE2}$, where I is the current flowing through R3. Since V+ substantially equals to V−, $V_{BE1}=I*R3+V_{BE2}$, from which I is derived to be: $I=(V_{BE1}-V_{BE2})/R3=\Delta V_{BE}/R3$, where $\Delta V_{BE}=V_{BE1}-V_{BE2}$. Vout is substantially equal to the sum of the voltages across R2, R3, and Q2. Therefore, $Vout=I*(R2+R3)+V_{BE2}$. Substituting I with the expression derived above, $Vout=(\Delta V_{BE}/R3)*(R2+R3)+V_{BE2}$. Note that $V_{BE2}$ is complementary to absolute temperature (CTAT) and $\Delta V_{BE}$ is proportional to absolute temperature (PTAT). By having a sum of $V_{BE2}$ and scaled-up $\Delta V_{BE}$, a first order bandgap voltage that is substantially temperature independent may be generated.

However, the conventional technique described above suffers from many disadvantages. First, the circuit 100 consumes significant power because a minimum current is dictated by a current gain (β) of the bipolar junction transistors, typically of the order of 200 nA, which is used to bias Q1 and Q2 reliably. Also, the circuit 100 occupies an unreasonable amount of silicon area due to the usage of the resistors whose sheet resistance may be of the order of tens of ohms.

To reduce the impact of high power consumption, one conventional low power design of a bandgap voltage generator exploits the PTAT behavior of a set of n-type metal oxide semiconductor (NMOS) transistors operating in weak-inversion region. The output reference voltage is a function of the drain current, the shape factor, and the current gain (β) of the transistors. However, careful crafting is needed to produce a PTAT voltage because the low power design relies on cancellation of threshold voltages between transistors of the same type but with different shape factors. Moreover, the performance of the low power design may be dominated by the mismatch between the transistors.

DESCRIPTION OF THE DRAWINGS

The present invention will be understood more fully from the detailed description that follows and from the accompanying drawings, which however, should not be taken to limit the appended claims to the specific embodiments shown, but are for explanation and understanding only.

DETAILED DESCRIPTION

In the following description, numerous specific details are set forth. However, it is understood that embodiments of the invention may be practiced without these specific details. In other instances, well-known circuits, structures, and techniques have not been shown in detail in order not to obscure the understanding of this description.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification do not necessarily all refer to the same embodiment. The term "to couple" as used herein may include both to directly couple and to indirectly couple through one or more intervening components.

In one embodiment, a reference voltage associated with a difference between a first threshold voltage of a first transistor and a second threshold voltage of a second transistor is generated. For example, the reference voltage may be substantially proportional to the difference between the threshold voltages. The first transistor and the second transistor may be biased at a predetermined ratio of currents between the first and the second transistors to reduce temperature dependence of the reference voltage. More details of some embodiments of the technique to reduce temperature dependence of the reference voltage are described below.

Figure 1:
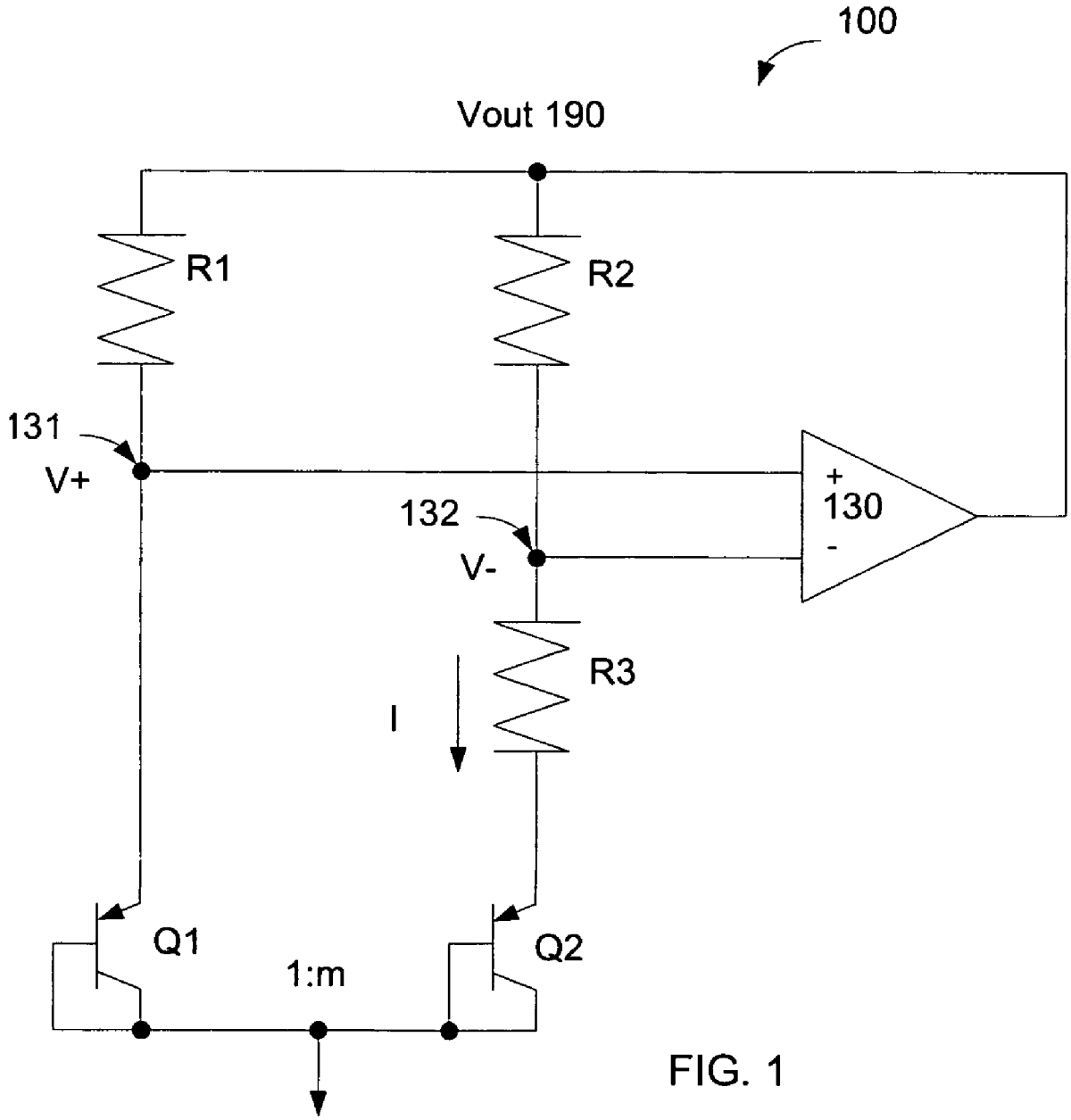
FIG. 1 shows a conventional first order bandgap reference voltage generating circuit.
Figure 2:
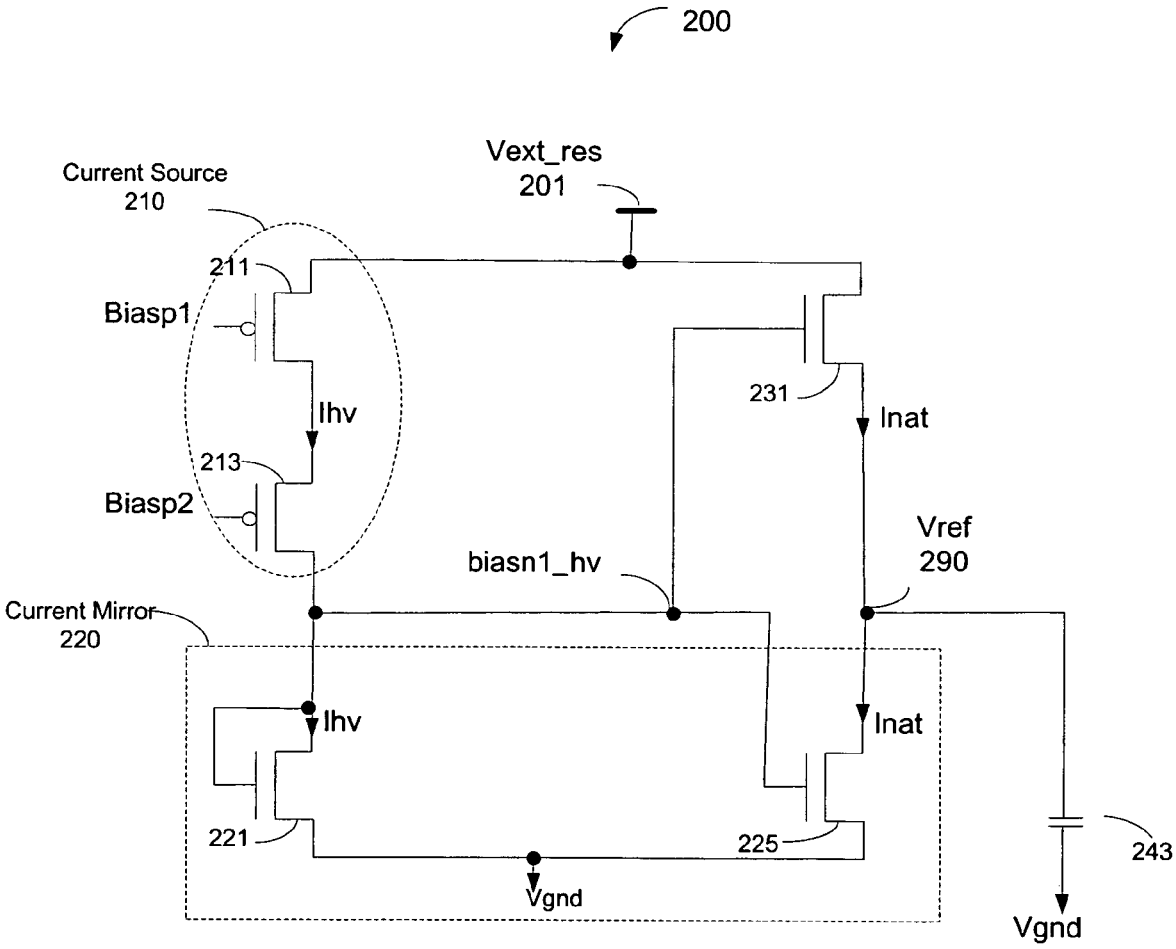
FIG. 2 shows one embodiment of a reference voltage generating circuit.

FIG. 2 shows one embodiment of a reference voltage generating circuit. The reference voltage generating circuit 200 includes a current source 210, a current mirror 220, a transistor 231 whose threshold voltage is different from that of transistor 221 in the current mirror 220, and a capacitor 243. Transistors 221 and 231 may be an n-type metal oxide semiconductor (NMOS) transistors. The source of transistor 231 is coupled to node 290.

In some embodiments, the current mirror 220 includes a pair of transistors 221 and 225. The drain of transistor 221 is coupled to the gate of transistor 221 and the gate of transistor 225. The sources of both transistors 221 and 225 are coupled to the ground. Transistors 221 and 225 may be of the same size. As such, the current Ihv flowing through transistor 221 may be duplicated or mirrored in the branch where transistor 225 is at. In some embodiments, transistors 221 and 225 are NMOS transistors. However, the transistors 221 and 225 may be of a different type of NMOS transistors than transistor 231. Thus, the threshold voltage of transistor 221 is different from the threshold voltage of transistor 231. To distinguish the two types of NMOS transistors, transistor 231 is hereinafter referred to as a native transistor 231. In some embodiments, native transistor 231 is biased at its gate by biasn1_hv, which is the voltage across the current mirror 220. The current flowing through native transistor 231 is designated as Inat.

In some embodiments, the current source 210 includes a pair of p-type metal oxide semiconductor (PMOS) transistors 211 and 213 coupled to each other in a cascode configuration. A source of transistor 211 is coupled to a supply voltage Vext_res 201 and a drain of transistor 211 is coupled to a source of transistor 213. The gates of transistors 211 and 213 are biased by biasing voltages, Biasp1 and Biasp2, respectively. Transistors 211 and 213 may generate a current, Ihv, which flows into transistor 221 of the current mirror 220. Note that other embodiments of the circuit 200 may include a current source built with different types of transistors in a different configuration.

As described above, the current Ihv flowing through transistor 221 may be duplicated or mirrored in the branch where transistor 225 is at. Since the drain of transistor 225 is coupled to node 290, the current Ihv flows out of node 290. The current flowing into node 290 is the current through transistor 231, i.e., Inat. An output reference voltage Vref is generated at node 290. When both transistors 221 and 231 are in weak-inversion region, Vref may be expressed as:

$$Vref=(Vth-Vthnat)+(Voffhv-Voffnat)+n(KT/Q)*\log_e\{m*Inat/Ihv\},$$

where Vth and Vthnat are the threshold voltages of transistors 221 and 231, respectively, Voffhv is the voltage at which the current through the transistor 221 is zero, Voffnat is the voltage at which the current through the transistor 231 is zero, K is Boltzmann constant, T is absolute temperature, Q is the magnitude of electronic charge, n is the sub-threshold slope factor of transistors 221 and 231, m is the ratio of currents between transistors 221 and 231, Ihv and Inat are the currents through transistors 221 and 231, respectively. Note that Ihv and Inat are proportional to the charge mobility exponents (μhv and μnat) of transistors 221 and 231, respectively. Thus, the ratio of Inat/Ihv is approximately equal to μnat/μhv.

Due to the term $n(KT/Q)*\log_e\{m*Inat/Ihv\}$, Vref may exhibit behavior complementary to absolute temperature (CTAT). In other words, Vref may be CTAT. Thus, in one embodiment, the term $n(KT/Q)*\log_e\{m*Inat/Ihv\}$ is set to zero to reduce the temperature dependence of Vref. Since n, K, T, and Q have non-zero values, the remaining expression in the above term, i.e., $\log_e\{m*Inat/Ihv\}$, is set to zero to make $n(KT/Q)*\log_e\{m*Inat/Ihv\}$ to be zero in one embodiment. Note that $\log_e\{m*Inat/Ihv\}=0$ when m*Inat/Ihv=1. Therefore, $\log_e\{m*Inat/Ihv\}=0$ when m=Ihv/Inat. As mentioned above, the ratio Ihv/Inat is substantially equal to the ratio of the respect mobility exponents of transistors 221 and 231, i.e., μhv/μnat. Therefore, m=μhv/μnat. Note that the values of μnat and μhv may vary from one process to another process. Nevertheless, both μnat and μhv may be expressed as a function of absolute temperature T. For example, in one embodiment, μnat is about $T^{-1.56}$ and μhv is about $T^{-1.32}$. As a result, $m=T^{-1.32}/T^{-1.56}=T^{0.24}$. At room temperature, i.e., 300 degrees in absolute temperature, $m=300^{0.24}$, which is about 3.93 in the current example. Therefore, by setting the ratio of currents between transistors 221 and 231 to be about 3.93, the CTAT behavior of Vref may be reduced in the current example. It should be appreciated that the value of m may vary in different embodiments depending on the process in which the circuit 200 is fabricated.

To set the ratio of currents between transistors 221 and 231 to be about the value of m determined as described above, the current source 210 generates the current Ihv, which flows to the current mirror 220 to bias transistor 221 within the current mirror 220. The current Ihv flowing through transistor 221 also results in a voltage, biasn1_hv. The voltage biasn1_hv is applied to the gate of native transistor 231 to bias native transistor 231 such that the current through transistor 231, Inat, is about Ihv/m. As a result, the ratio of currents between transistors 221 and 231, i.e., Ihv/Inat, is at about the predetermined value of m. Thus, the shape factor of transistor 225 is chosen such that Inat is at about Ihv/m.

Note that the technique disclosed above may be applied to various processing technologies in which at least two different types of transistors with different threshold voltages are available. Furthermore, in an alternate embodiment, transistors 231, 221, and 225 in the reference voltage generating circuit 200 may be replaced with PMOS transistors.

Figure 3:
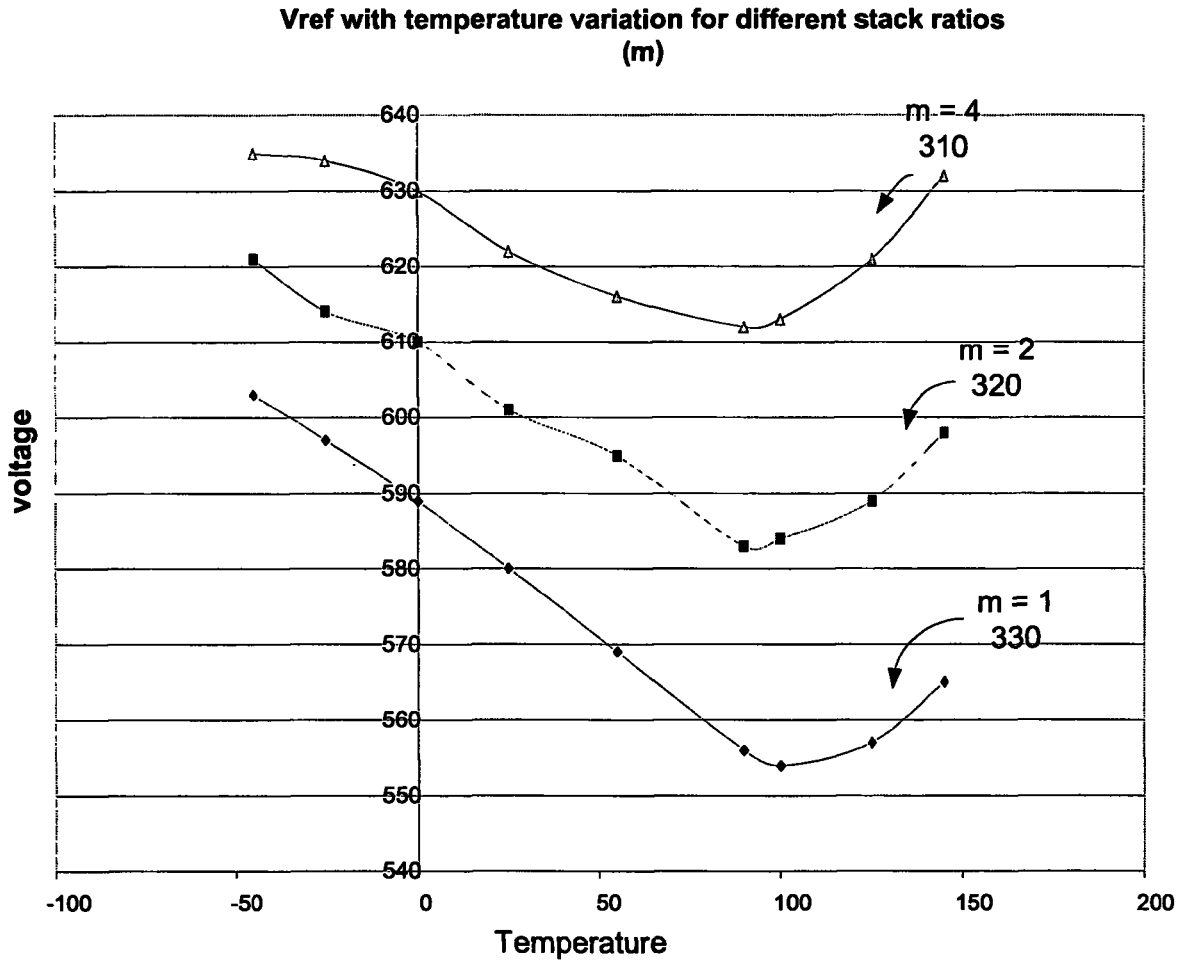
FIG. 3 shows exemplary reference voltages at different temperatures with different stack ratios.

FIG. 3 shows exemplary reference voltages at different temperatures with different values of m for the process discussed in the above example. Curve 310 corresponds to m=4, curve 320 corresponds to m=2, and curve 330 corresponds to m=1. As shown in FIG. 3, the variation of Vref across different temperatures reduces as the value of m becomes closer to 3.93. For example, at m=4, the temperature coefficient of Vref has about 50% improvement over the temperature coefficient of Vref at m=1.

As demonstrated by the data shown in FIG. 3, the reference voltage generating circuit 200 may reduce temperature dependence of the reference voltage at a lower current budget. In some embodiments, the lower current budget is about 20 nA. In other words, the temperature coefficient of the reference voltage may be improved by the above technique in some low power design of semiconductor circuits. Furthermore, the circuit 200 includes a small number of transistors, thus, it is relatively easy to debug during circuit design. Another advantage of the circuit 200 is that the circuit 200 occupies less silicon area than some conventional designs that include resistors. As a result, the cost of the semiconductor chip incorporating the circuit 200 may be reduced.

Figure 4:
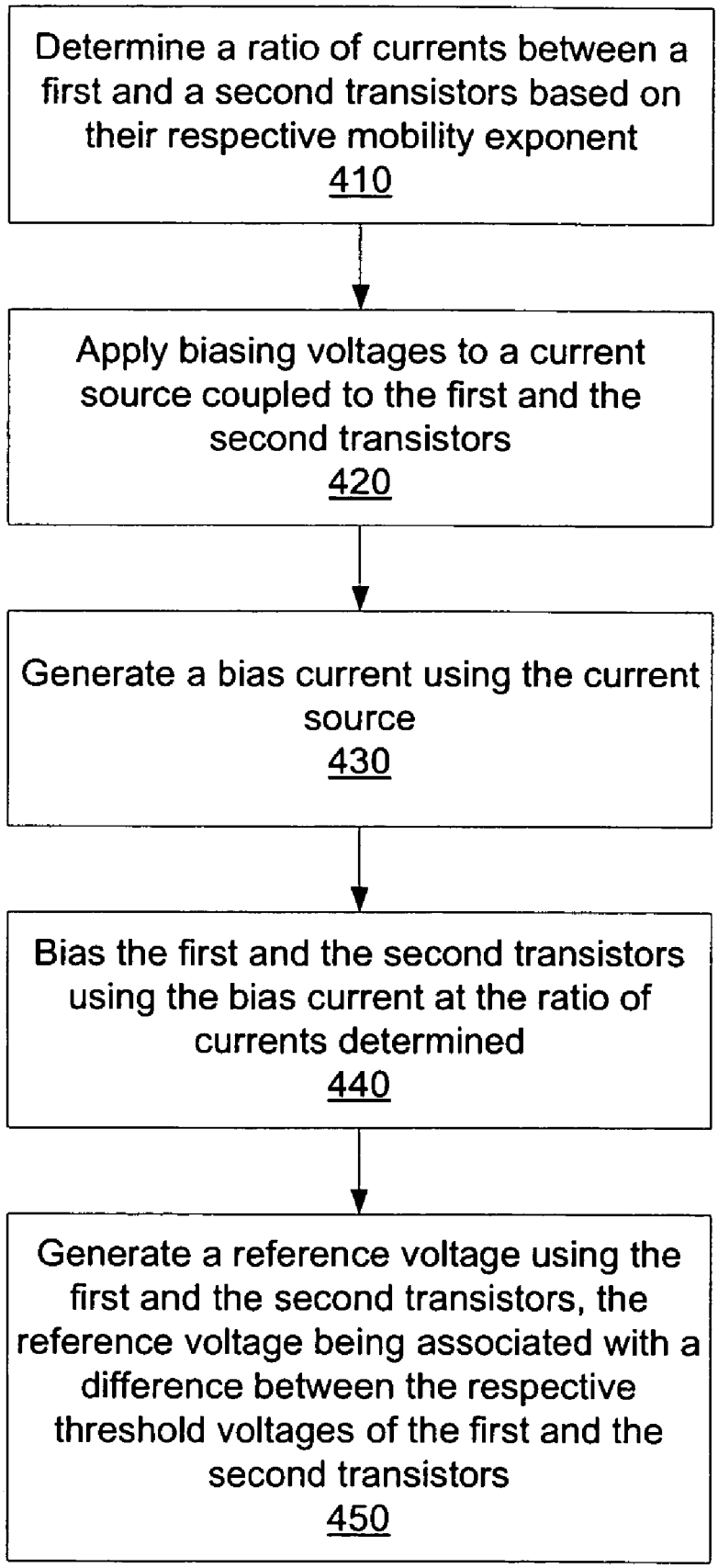
FIG. 4 shows one embodiment of a process to reduce temperature dependence of a reference voltage.

FIG. 4 shows one embodiment of a process to reduce temperature dependence of a reference voltage. The process is performed by processing logic that may comprise hardware (e.g., circuitry, dedicated logic, etc.), software (such as is run on a general-purpose computer system, a server, or a dedicated machine), or a combination of both.

In one embodiment, processing logic determines a ratio of currents between two transistors of different types in a reference voltage generating circuit based on the respective charge mobility exponents of the transistors (processing block 410). Note that the two transistors have different threshold voltages and the reference voltage to be generated corresponds to the difference between the two threshold voltages.

Processing logic may apply biasing voltages to a current source coupled to the two transistors (processing block 420). In some embodiments, the current source includes a pair of transistors in cascade configuration. Processing logic may then generate a bias current using the current source in response to the biasing voltages (processing block 430). Processing logic may bias the two transistors using the bias current at the ratio of currents determined above (processing block 440). Finally, processing logic generates a reference voltage using the two transistors (processing block 450). As mentioned above, the reference voltage may be associated with the difference between the thresholds voltages of the two transistors. Because of the biasing of the two transistors at the ratio of currents determined, the temperature dependence of the reference voltage generated is significantly reduced.

Figure 5:
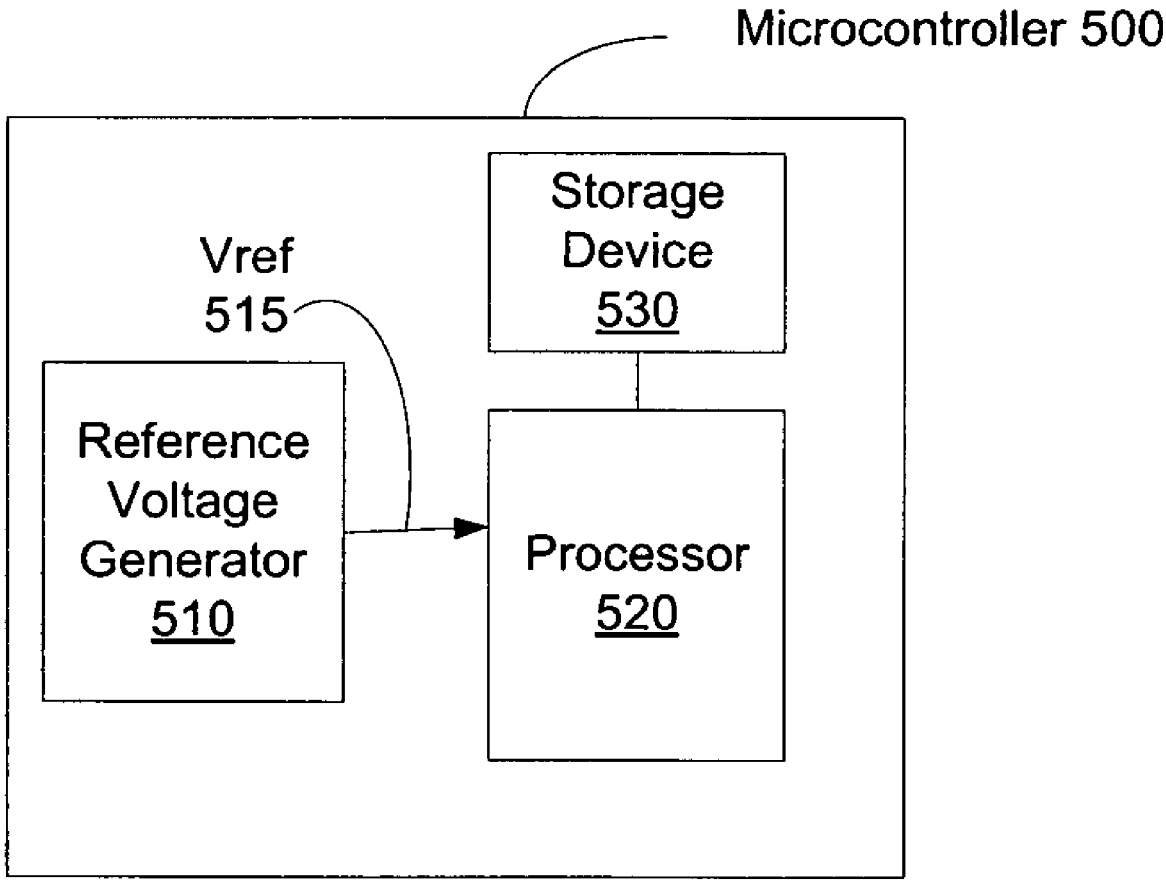
FIG. 5 shows one embodiment of a microcontroller.

FIG. 5 illustrates one embodiment of a microcontroller 500 usable with some embodiments of the reference voltage generating circuit described above. The microcontroller 500 includes a reference voltage generator 510, a processor 520, and a storage device 530. The storage device 530 may include any combination of different types of storage devices, such as, for example, dynamic random access memory (DRAM), flash memory, EPROMs, EEPROMs, etc. In some embodiments, the microcontroller 500 is programmed by storing a program or a set of programs in the storage device 530. The program(s) may include various types of instructions executable by the processor 520. The program(s) stored may be modified later by reprogramming the microcontroller 500.

In some embodiments, the components of the microcontroller 500 reside on a common integrated circuit substrate. In other words, the components are fabricated on a single semiconductor chip. Thus, the microcontroller 500 may be referred to as a programmable system on a chip.

The processor 520 may include one or more general-purpose processing devices such as a microprocessor or central processing unit, a network processor, or the like. Alternatively, the processor 520 may include one or more special-purpose processing devices such as a digital signal processor (DSP), an application specific integrated circuit (ASIC), a field programmable gate array (FPGA), or the like. The processor 520 may also include any combination of a general-purpose processing device and a special-purpose processing device.

The storage device 530 may store instructions to be executed by the processor 520. Using the reference voltage Vref 515 generated by the reference voltage generator 510, the processor 520 may execute the instructions from the storage device 530. A relatively stable reference voltage Vref 515 may help to improve the accuracy of the processor 520. Furthermore, since the microcontroller 500 may be used in different environments, it is advantageous for the reference voltage Vref 515 to remain relatively stable and predictable within a wide range of temperature. Thus, the technique described above to reduce the temperature dependence of the reference voltage is useful in allowing the microcontroller 500 to operate within a wide range of temperature. Details of some embodiments of the reference voltage generator 510 capable of generating a reference voltage with reduced temperature dependence have been described above.

Note that any or all of the components of the microcontroller 500 and associated hardware may be used in various embodiments of the present invention. However, it can be appreciated that other configurations of the microcontroller 500 may include additional or fewer components than those illustrated in FIG. 5.

The foregoing discussion merely describes some exemplary embodiments of the present invention. One skilled in the art will readily recognize from such discussion, the accompanying drawings, and the claims that various modifications can be made without departing from the spirit and scope of the appended claims. The description is thus to be regarded as illustrative instead of limiting.

What is claimed is:

1. A method, comprising:

generating a reference voltage associated with a difference between a first threshold voltage of a first transistor and a second threshold voltage of a second transistor, wherein a current mirror includes the first transistor and is coupled with the second transistor;

generating a first current by applying a plurality of voltages to a plurality of transistors interconnected in a cascode configuration;

biasing the first transistor with the first current; and reducing temperature dependence of the reference voltage by biasing the second transistor with a second current generated by the current mirror, wherein the first current is proportional to the second current according to a predetermined ratio substantially equal to a ratio of a first charge mobility exponent of the first transistor and a second charge mobility exponent of the second transistor, and wherein the second charge mobility exponent is different from the first charge mobility exponent.

2. The method of claim 1, wherein the first current is generated using a current source to bias the first transistor.

3. The method of claim 1, wherein the first and the second transistors are of different types.

4. The method of claim 1, further comprising:

providing the reference voltage to a processor;

retrieving a plurality of instructions from a storage device using the processor; and executing the plurality of instructions retrieved with the processor using the reference voltage.

5. An apparatus, comprising:

a current mirror including a first transistor;

a second transistor coupled to the current mirror, wherein the second transistor is configured to generate a reference voltage in operation with the first transistor; and a current source coupled to the first and the second transistors to reduce temperature dependence of the reference voltage by biasing the first transistor and the second transistor at a predetermined ratio of currents of the first and the second transistors, wherein the predetermined ratio is substantially equal to a ratio of a first charge mobility exponent of the first transistor and a second charge mobility exponent of the second transistor, and wherein the second charge mobility exponent is different from the first charge mobility exponent, wherein the current source comprises a first p-type transistor and a second p-type transistor coupled to each other in a cascode configuration.

6. The apparatus of claim 5, wherein the first transistor comprises a first drain, a first gate, and a first source, the second transistor comprises a second drain, a second gate, and a second source, the first gate is coupled to the first drain and the second gate, and the second source is coupled to an output node from which the reference voltage is output.

7. The apparatus of claim 6, wherein the reference voltage is output at the second source of the second transistor and is associated with a difference between a first threshold voltage of the first transistor and a second threshold voltage of the second transistor.

8. The apparatus of claim 6, wherein a drain of the second p-type transistor is coupled to the first gate of the first transistor, and a source of the first p-type transistor is coupled to the second drain of the second transistor.

9. The apparatus of claim 6, wherein the current mirror comprises:

the first transistor; and a third transistor having a third drain, a third gate, and a third source, the third drain coupled to the output node, the third gate coupled to the first gate and the first drain, and the third source coupled to ground.

10. The apparatus of claim 6, further comprising:

a capacitor coupled between the second source of the second transistor and ground.

11. The apparatus of claim 5, wherein the first and the second transistors are of different types.

12. The apparatus of claim 5, further comprising:

a storage device to store a plurality of instructions; and a processor coupled to the storage device, the first transistor, and the second transistor, the processor to retrieve the plurality of instructions from the storage device and to execute the plurality of instructions retrieved using the reference voltage.

13. The apparatus of claim 12, wherein the processor, the storage device, and the first and second transistors reside on a common integrated circuit substrate.

14. An apparatus, comprising:

means for generating a reference voltage associated with a difference between a first threshold voltage of a first transistor and a second threshold voltage of a second transistor, wherein a current mirror includes the first transistor and is coupled with the second transistor; and means for reducing temperature dependence of the reference voltage by generating a current to bias the first and the second transistors at a ratio of currents of the first and the second transistors, wherein the ratio of currents is substantially equal to a ratio of a first charge mobility exponent of the first transistor and a second charge mobility exponent of the second transistor, wherein the second charge mobility exponent is different from the first charge mobility exponent, and wherein generating the current comprises applying a plurality of voltages to a plurality of transistors interconnected in a cascode configuration.

15. The apparatus of claim 14, wherein the first and the second transistors reside on a common integrated circuit substrate and are of different types.

* * * * *